US005772265A

United States Patent [19]

Gilbert

[11] Patent Number: 5,772,265

[45] Date of Patent: Jun. 30, 1998

[54] DOOR SECURITY LOCK

[76] Inventor: Anthony Odell Gilbert, 7246 Skybright La., Houston, Tex. 77095

[21] Appl. No.: 139,574

[22] Filed: Oct. 20, 1993

[51] Int. Cl.[6] ..... E05C 3/04

[52] U.S. Cl. ..... 292/207; 292/210; 292/292; 292/297

[58] Field of Search ..... 292/205, 207, 292/210, 218, 288, 289, 292, 297, 298, 302, 304, 341.17

[56] References Cited

U.S. PATENT DOCUMENTS

| | | | |
|---|---|---|---|
| 966,349 | 8/1910 | McCullah | 292/341.17 X |
| 1,210,826 | 1/1917 | Minor | 292/210 X |
| 1,288,988 | 12/1918 | Reed | 292/297 |
| 1,312,931 | 8/1919 | Tenny | 292/205 |
| 1,549,182 | 8/1925 | Church | 292/292 |
| 1,633,645 | 6/1927 | Molberg | 292/304 X |
| 1,650,146 | 11/1927 | Moore | 292/210 |
| 1,706,995 | 3/1929 | Bovey | 292/210 X |
| 2,644,708 | 7/1953 | Poole | 292/210 X |
| 4,871,203 | 10/1989 | Rogers | 292/106 X |

FOREIGN PATENT DOCUMENTS

| | | | |
|---|---|---|---|
| 751628 | 1/1967 | Canada | 292/296 |
| 368454 | 3/1932 | United Kingdom | 292/210 |

*Primary Examiner*—Suzanne Dino
*Attorney, Agent, or Firm*—Gunn & Associates, P.C.

[57] ABSTRACT

A drop bolt system provides a low profile, simplified arrangement of a central metal plate, a metal doorjamb restraint and a plate latch. This system prevents overriding the door security system from a position exterior to the protected door.

11 Claims, 6 Drawing Sheets

FIG. 7
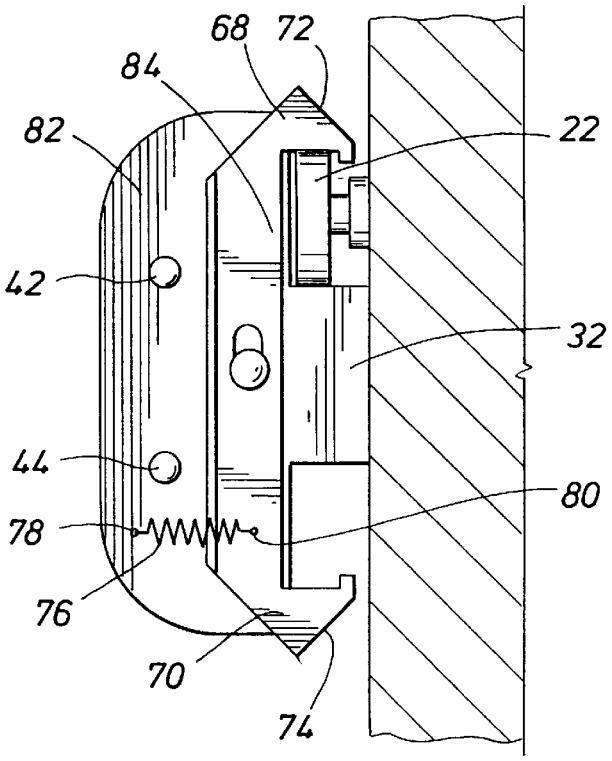
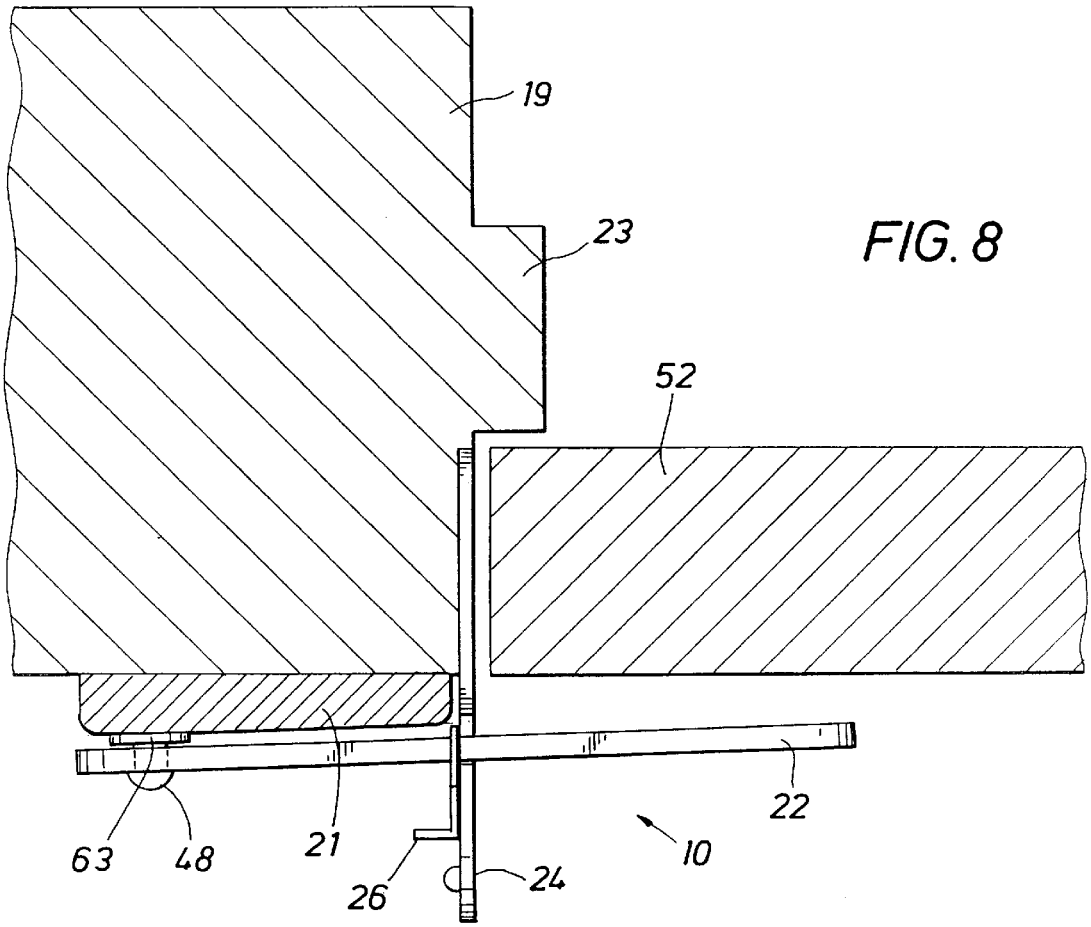
FIG. 8

DOOR SECURITY LOCK

FIELD OF THE INVENTION

The present invention relates generally to the field of secure door locking apparatus and, more particularly, to improved methods and apparatus for securing a door without relying upon the hardware of a conventional door latch.

BACKGROUND OF THE INVENTION

A variety of door security devices, safety latches, and door locks and restraints have been suggested to prevent the unauthorized intrusion into homes or apartments. Unfortunately, many security devices can be defeated by intruders and do not offer the desired assurance of security. Other door security devices are difficult to manufacture, install, or use. Many door security devices include complicated and expensive parts and are therefore not regularly used by the people the security devices are intended to protect. Finally, many door security devices functionally depend on the design of the door knob, and/or operate in conjunction with the striker plate in the door jamb adapted for receiving the door latch. Because of this dependence on a specific door design, these devices cannot be used on all doors, and the location of the security device is necessarily determined by the location of the conventional door latching device.

Some governments have long recognized the need to require providers of multi-unit housing and/or rental properties to include door security devices for their tenants. Even recently, the requirements for these security devices have been further refined. For example, the State of Texas recently amended the Texas Property Code §§92.151–92.170, relating to security devices for certain rental dwellings. This law requires a keyless bolting device on each exterior door of a rental dwelling.

This law also provides several options to satisfy this requirement by further defining a "keyless bolting device." One option defines a keyless bolting device as a door lock not in the doorknob that locks by a drop bolt system operated by placing a central metal plate over a metal doorjamb restraint that protrudes from the doorjamb and that is affixed to the doorjamb frame by means of three case-hardened screws at least three inches in length. One-half of the central plate must overlap the interior surface of the door and the other half of the central plate must overlap the doorjamb when the plate is placed over the doorjamb restraint. The drop bolt system must prevent the door from being opened unless the central plate is lifted off of the doorjamb restraint by a person who is on the interior side of the door.

One effort to satisfy this definition is illustrated by Fontenot, U.S. Pat. No. 5,098,142. The device of Fontenot includes a door jamb restraint independent of the conventional striker plate and secured to a door facing surface of the door jamb. Unfortunately, the restraint of Fontenot is unnecessarily large and cumbersome. The Fontenot restraint also provides a high profile from the door and doorjamb that it is used on. Such a high profile has been known to cause a problem by striking people who walk by too close to the door. Finally, the Fontenot restraint is more complex than necessary and therefore too expensive.

Thus, there remains a need for a door security restraint that is simple and inexpensive and that provides a low profile. Such a door security restraint should minimize the amount of material necessary to provide security while still satisfying, at least, the definition dictated by the Texas statute. The restraint should also be simple to use to encourage use of the device.

SUMMARY OF THE INVENTION

The restraint of the present invention solves these and other problems noted in known door security safety restraints. The door restraint of the present invention includes a rotatable central metal plate of heavy gauge metal that withstands a force exerted by someone seeking unauthorized entry into a dwelling. The rotatable central metal plate fits over a metal doorjamb restraint that protrudes from the doorjamb sufficiently to accept the central plate, yet still provides a low profile from the restrained door. The doorjamb restraint is fixed to the doorjamb frame by, for example, at least three case-hardened screws. When rotated into place, the central plate extends half onto the interior surface of the door and half onto the doorjamb. A simple, central plate latch may be removably extended over the central plate to prevent the central plate from being dislodged from the metal doorjamb from the exterior of the door. But the central plate latch is simple in construction and easy to use thus encouraging tenants in rental dwellings to use the security device of the present invention.

These and other advantages and features of the present invention will be apparent to those of skill in the art when they read the following detailed description along with the accompanying drawing figures.

BRIEF DESCRIPTION OF THE DRAWINGS

FIG. 7 is a side elevation view of the door restraint, also in a latched condition, illustrating an additional automatic latching feature.

FIG. 8 is a top section view of the drop bolt system depicting the arrangement of the system adjacent a door, doorjamb, and door casing.

DETAILED DESCRIPTION OF A PREFERRED EMBODIMENT

Figure 1:
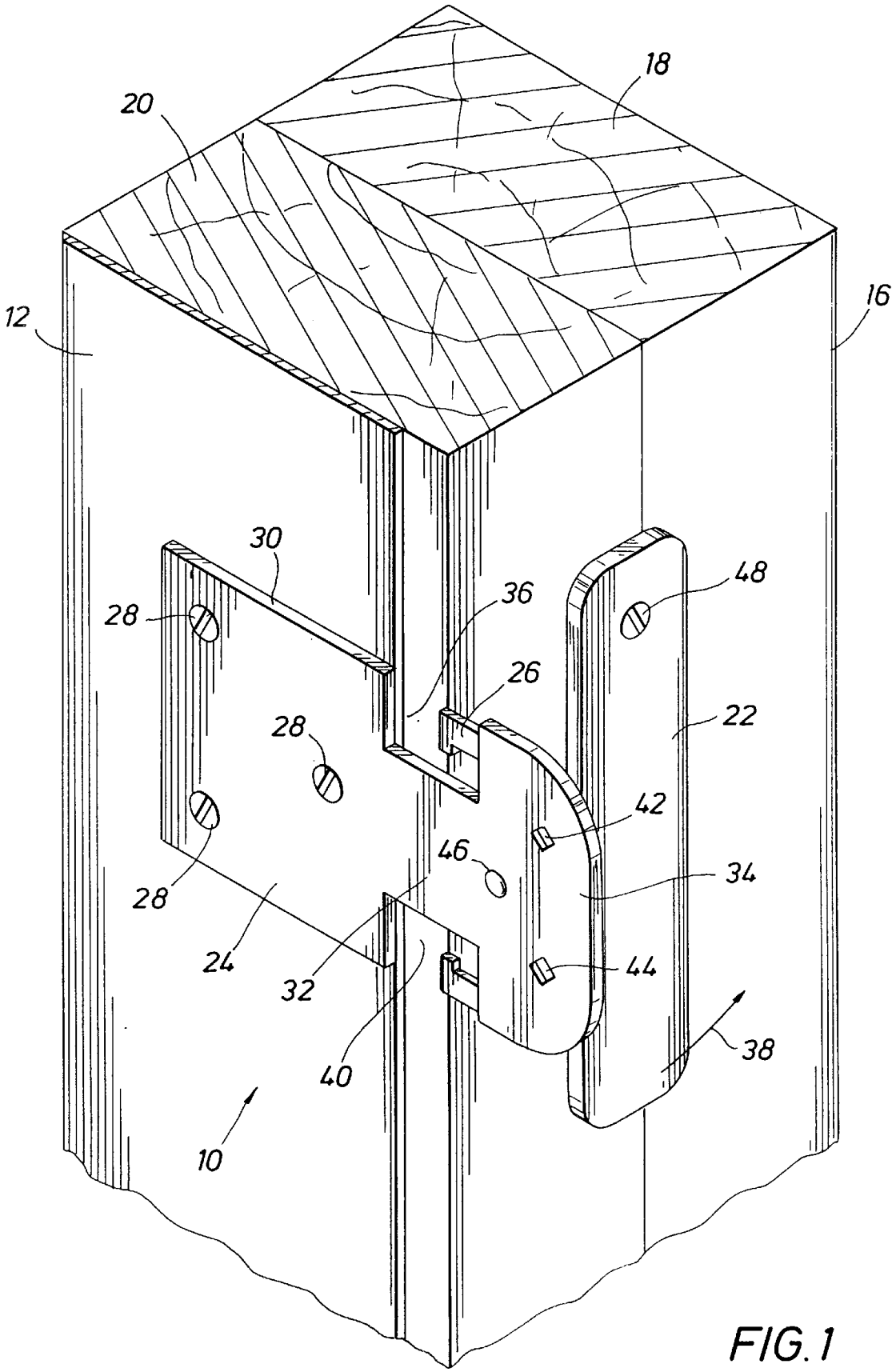
FIG. 1 is an isometric view of a door security restraint device or drop bolt system of the present invention in an unlatched condition.

FIG. 1 depicts a preferred embodiment of a door security device 10 of the present invention in an unlatched state. The Texas law referenced above refers to the door security device 10 as a drop bolt system and these terms are used herein interchangeably. The device 10 mounts to a doorjamb 12, shown in FIG. 1. The doorjamb itself is a face of a doorjamb frame 19 (FIG. 2), commonly attached to a "cripple" comprised of two stacked two-by fours 18 and 20.

The restraint 10 comprises three major parts: a central metal plate 22, a metal doorjamb restraint 24, and a central plate latch 26. The central plate latch 26 is mostly hidden in the view of FIG. 1 and is shown in greater detail in FIGS. 5–7.

The metal doorjamb restraint 24 is secured to the doorjamb, preferably by at least three case-hardened screws 28, in accordance with the law referenced above. The metal doorjamb restraint 24 comprises a mounting plate 30, a bridge member 32, and a stop extension 34. The mounting plate 30 is drilled or otherwise formed to accept the screws 28 or other appropriate mounting apparatus that satisfies the statutory or other regulatory requirements. The mounting plate mounts directly to a door jamb, or possibly to a facing 14 (FIG. 3), which may be made and sold as a unit as part of the entire drop bolt system. The bridge member 32 is preferably formed as a unitary piece with the mounting plate, or by machining stock material to form a central-plate receiving slot 36. The slot 36 receives the central metal plate when the plate is rotated by about 270° in the direction shown by the arrow 38. The bridge member 32 may also include a slot 40 that makes the doorjamb restraint symmetrical for ease of manufacture and so that the doorjamb restraint can be used for either left-hand or right-hand doors without modification.

As shown in FIG. 1, the stop extension 34 provides a low profile to the doorjamb, extending only so far from the doorjamb as is necessary to provide for the reception of the central plate 22 and mechanical rigidity. The stop extension 34 is so called because it prohibits the central plate 22 from inward movement as force is applied to the exterior of the door while the central plate 22 is in a latched state (FIG. 2), and because it includes central plate latch stops 42 and 44. The latch stops 42 and 44 limit the range of rotation of the plate latch 26 and may be formed on the stop extension by any appropriate means but preferably by punching out material from the extension 34.

The plate latch 26 is preferably rotatably mounted to the extension 34 by a rivet 46 or any suitable means that permits easy rotation of the latch 26. The latch 26 will rotate easily until it contacts either of the latch stops 42 or 44.

The central metal plate 22 is rotatably mounted to the doorjamb casing 21 (FIG. 8) by, for example, a screw 48. Between the central plate 22 and the doorjamb casing 21 is a bushing 60 and washer 62 (see FIGS. 6 and 7) or a unitary bushing/washer combination 63 (see FIG. 8) to allow free rotation of the central plate 22 without abrading against the doorjamb casing 21. The central plate is preferably mounted on the doorjamb casing at a distance from the central-plate receiving slot 36 so that, when the central plate 22 is rotated about 270° from the position shown in FIG. 1 so that the central plate is placed over the doorjamb restraint 24, half of the central plate will overlap the interior surface of the door and half of the metal plate will overlap the doorjamb (see FIG. 4). In a preferred embodiment, the central plate is about 5" long so that 2½" overlaps each of the door and the doorjamb.

Figure 2:
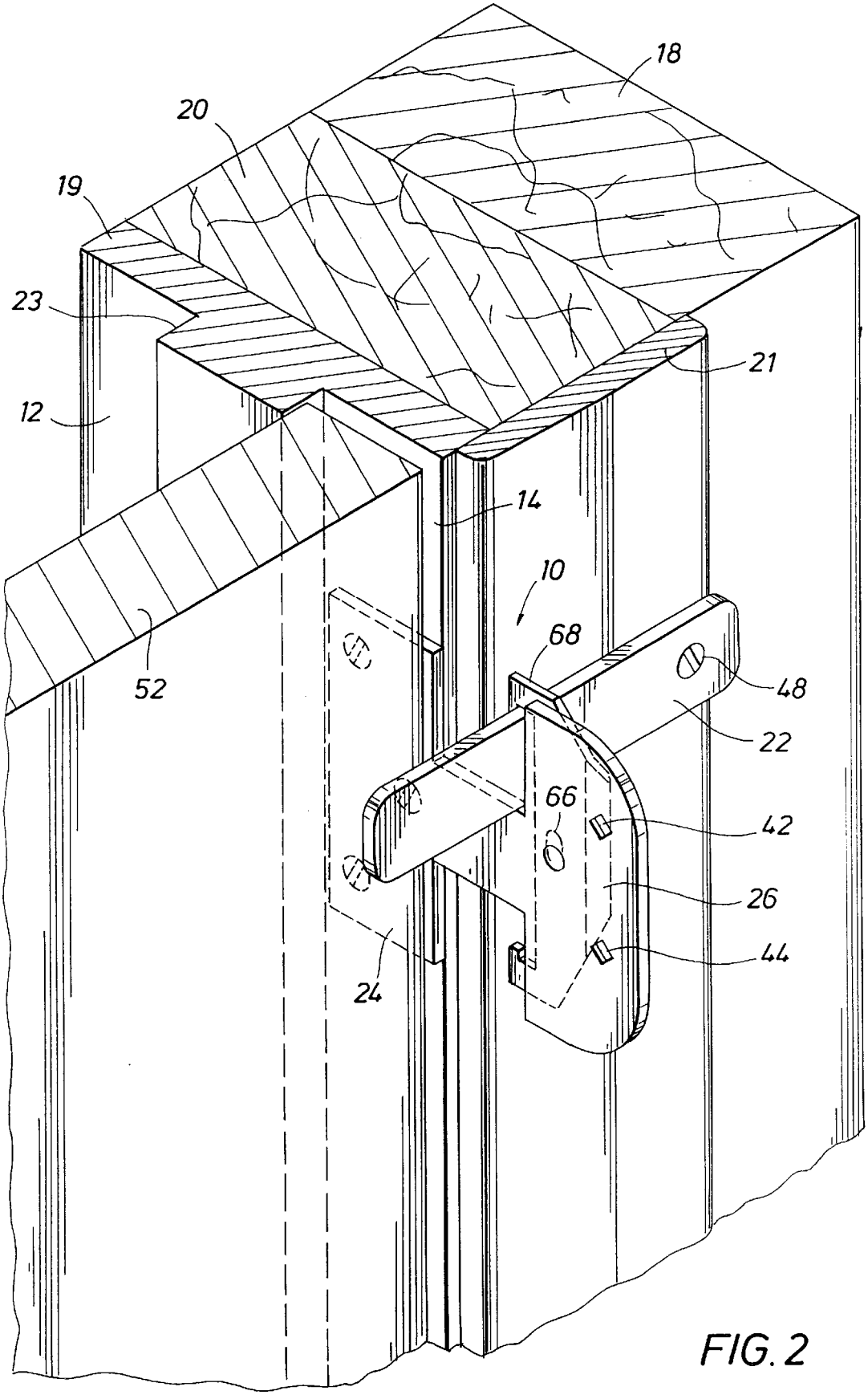
FIG. 2 is an isometric view of the door security restraint of FIG. 1, here shown latched.

FIG. 2 depicts the drop bolt system 10 of the present invention in a latched state. In FIG. 2, the central plate 22 has been rotated about its rotation axis 48 until it is placed over the doorjamb restraint 24. The plate latch 26 has been lifted, rotated, and positioned over the central plate to latch the central plate in a secure position. In this position, unauthorized opening of the door is prevented since the plate latch 26 can only be lifted from the central plate 22 from the interior of the door. Those of skill in the art will appreciate that in the preferred embodiment of FIGS. 1 and 2, the latch mechanism operates strictly manually, through conscious effort of a resident inside the dwelling. The operation, however, is quick and easy. This configuration thus advantageously satisfies the requirements of the Texas statute and provides additional advantages over known drop bolt systems.

FIG. 2 also shows a common arrangement of a doorjamb 19 that is an integral part of the door frame. The doorjamb 19 also includes an abutment 23 that limits the closing movement of a door 52 and further precludes unauthorized tampering with the drop bolt system. FIG. 2 also shows the plate latch 26 (behind the doorjamb restraint 24. These features are described in greater detail with regard to FIGS. 5–7.

Figure 3:
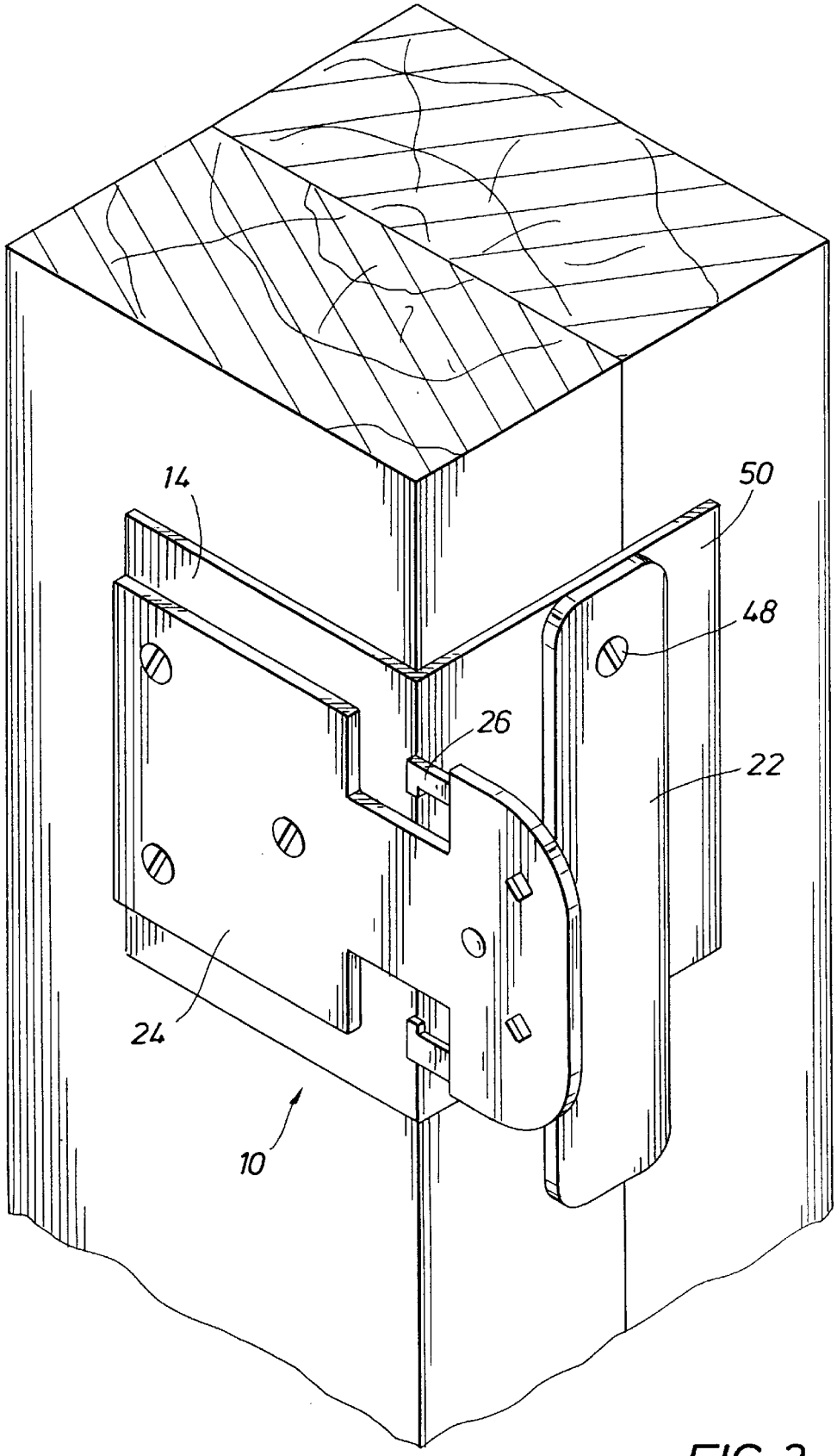
FIG. 3 is an isometric view of a door security restraint of the present invention with a doorjamb extension to simplify construction and installation of the restraint.

FIG. 3 depicts an alternative feature of the present invention. In this case, the central metal plate 22, the metal doorjamb restraint 24, and the central plate latch 26 are the same as those in FIGS. 1 and 2. However, a facing extension 50 provides an alternative mounting surface for the central plate 22. In this way, the central plate 22 can be mounted to the facing extension 50 as a prefabricated unit, ensuring the proper distance of the rotation axis 48 from the doorjamb restraint 24 in accordance with the statutory requirements. This arrangement also significantly simplifies the installation of the drop bolt system. The only drawback of this arrangement is the requirement of slightly more material and consequently slightly higher cost.

Figure 4:
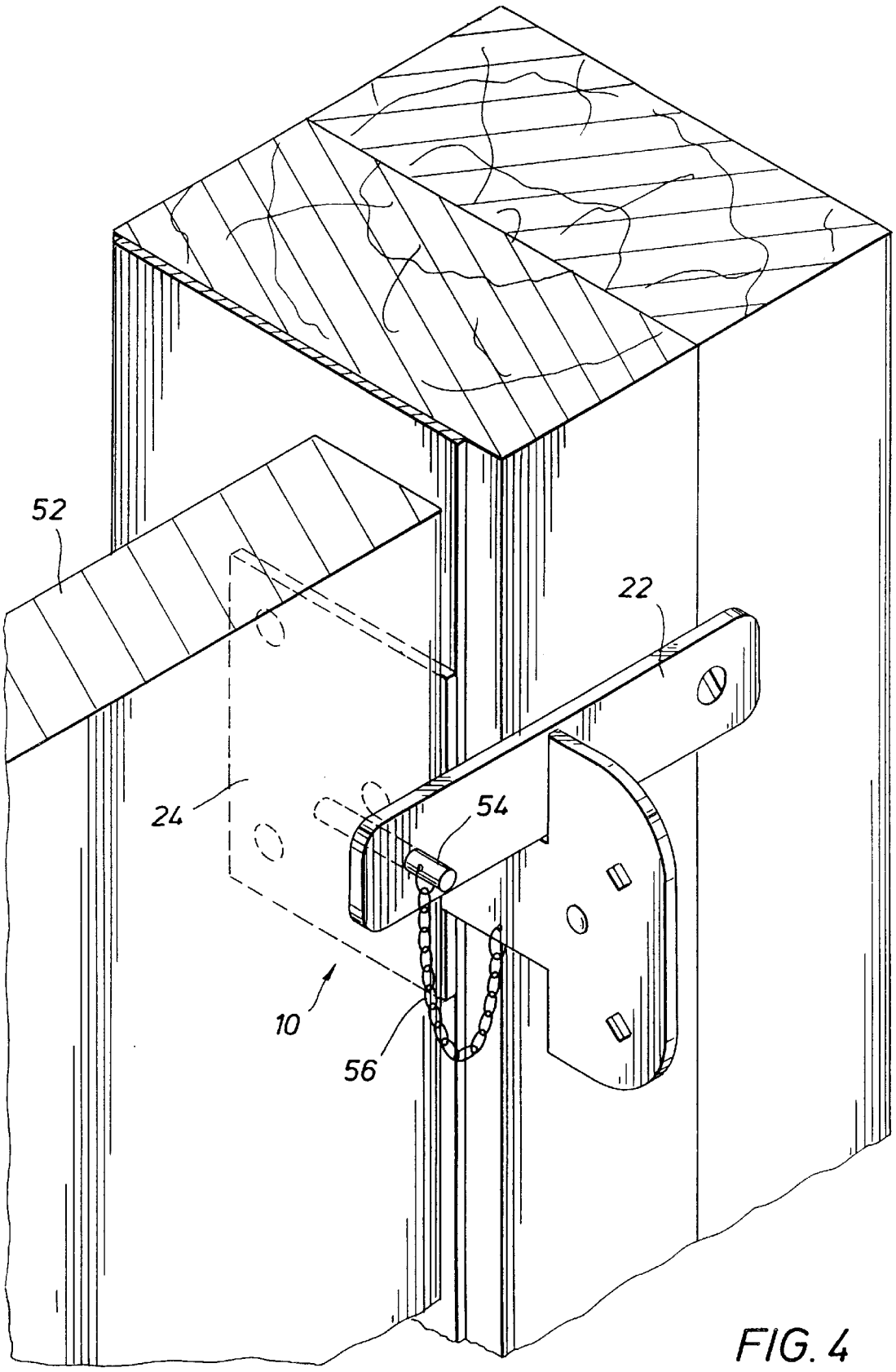
FIG. 4 is an isometric view of an alternative embodiment of the door security restraint of the present invention that provides a pin-and-chain arrangement to prevent unauthorized lifting of the central plate off the doorjamb restraint.

FIG. 4 depicts an alternative means of securing the central metal plate 22 against unauthorized intrusion. Figure also shows the location of a door 52 adjacent to the drop bolt system 10 in place. The drop bolt system 10 of this embodiment includes a pin 54 that prevents the door from being opened unless the central plate 22 is lifted off of the doorjamb restraint 24 by a person who is on the interior side of the door 52, in this case by removing the pin 54 to permit rotation of the central plate 22. The pin 54 may be secured to the bridge member 32, or any other component of the device, by a chain 56 or any other means that keeps the pin 54 handy for use.

Figure 5:
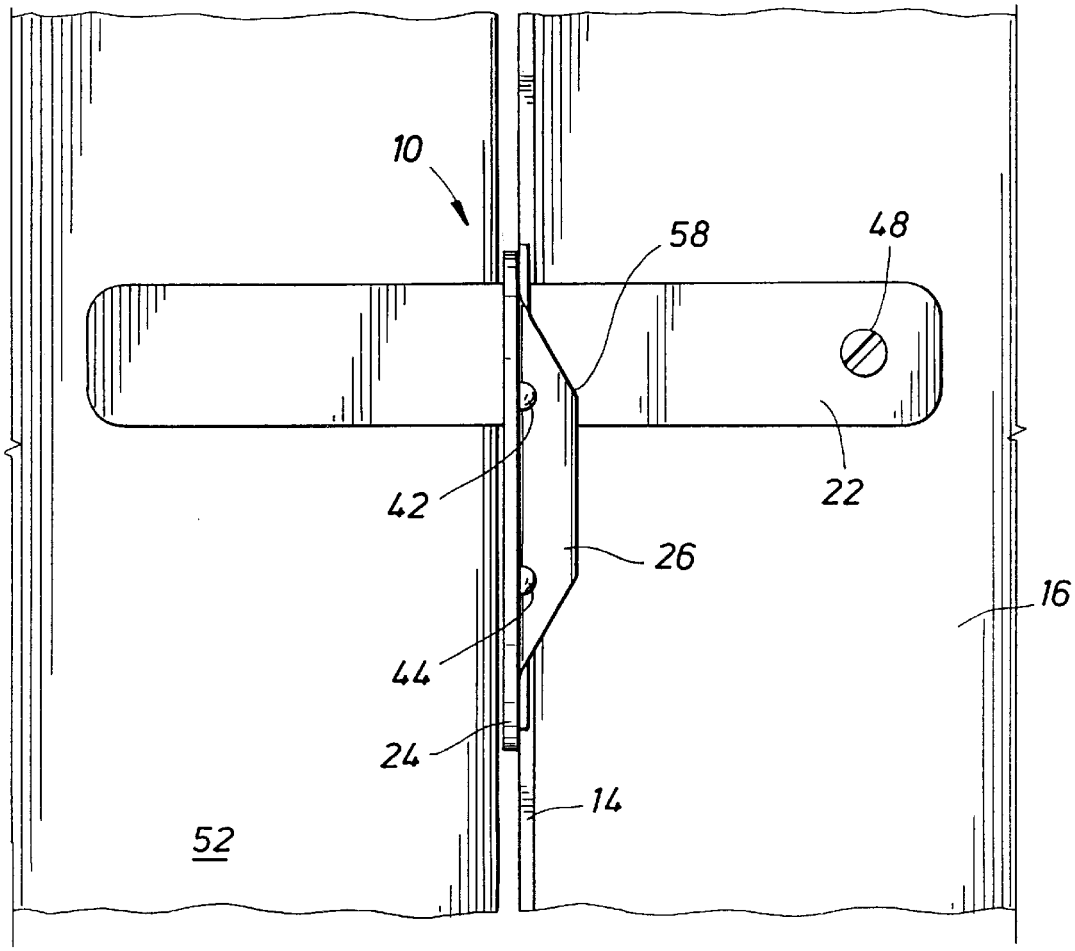
FIG. 5 is a front elevation view of the door restraint in a latched condition.

FIG. 5 depicts a front elevation view of the drop bolt system 10 of the present invention. The central metal plate 22 is shown latched in place by the central plate latch 26. The plate latch 26 may have formed therein an L-shaped flange 58, either by machining the latch 26 from L-shaped stock or by forming the latch 26 from flat stock and bending the L-shaped flange 58 to shape. The flange 58 provides additional mechanical rigidity to the latch 26.

Excessive rotation in a plane normal to the drawing of FIG. 5 is prevented by latch stops 42 and 44. The latch stops 42 and 44 may be formed in the metal doorjamb restraint 24 as previously described. As shown in FIG. 5, the central plate 22 overlaps the door 52 and the doorjamb frame 16 equally, in a preferred embodiment about two and a half inches over each.

Figure 6:
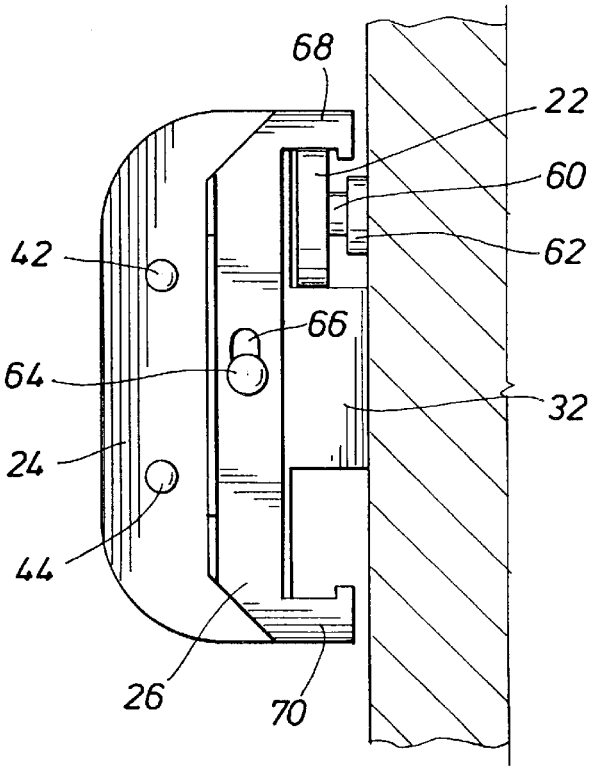
FIG. 6 is a side elevation view of the door restraint showing the central plate latch securing the central metal plate.

FIGS. 6 and 7 depict side views of the drop bolt system, providing additional details of the central plate 22, the doorjamb restraint 24, and the plate latch 26. As previously described, the central plate 22 is mounted to the doorjamb casing with a bushing 60 and/or washer 62 to permit free rotation of the central plate 22 without contacting the doorjamb casing. The latch stop 42 defines the extent of counter-clockwise rotation of the plate latch 26 (in the views of FIGS. 6 and 7) and the latch stop 44 defines the extent of clockwise rotation.

Secured to the doorjamb restraint 24 and extending from the rivet 46 (FIG. 1) is a rivet head 64. The rivet head 64 movably holds the plate latch 26 through a slot 66 formed in the latch 26. The slot 66 permits the vertical movement of the latch, shown in FIG. 6 as near the highest vertical extent of its play. This vertical movement of the latch permits placing a hook extension 68 over the central plate 22 to secure it in place. The plate latch 26 also includes a hook extension 70 for symmetry so that the plate latch 26 can be used on right-handed or left-handed doors, i.e., oriented either way. Note that the holes for the screws 28 are countersunk only of the face away from the doorjamb. Thus, the central plate latch 26 must be located away from the door 52 and toward the doorjamb 19 to provide additional protection against unauthorized entry.

FIG. 7 depicts an additional feature of hands-free latching. In FIG. 7, the hook extensions 68 and 70 include ramps 72 and 74. As the central metal plate 22 is rotated toward its latched position, it strikes the ramp 72 (or 74 in the inverted position) and this action automatically opens the latch 26 against the pressure of a biasing means such as a spring 76. The spring 76 is mounted to the doorjamb restraint at a hole 78 and to the latch at another hole 80. Manufacture includes corresponding holes 82 and 84 for the inverted orientation of the mechanism. Thus, a conscious effort is required only to unlatch the drop bolt system and this can still only be accomplished from inside the door.

FIG. 8 depicts a preferred mounting for the present invention. The drop bolt system 10 comprises a central metal plate 22, a metal doorjamb restraint 24, and a central plate latch 26. The central plate 22 is rotatably mounted to a casing 21 with a screw 48 or similar securing device to provide free rotation of the central plate 22. The jamb 19 includes an abutment 23 to limit door 52 rotation. The abutment also serves to prevent unauthorized tampering with the drop bolt system 10 from outside the door.

The principles, preferred embodiment, and mode of operation of the present invention have been described in the foregoing specification. This invention is not to be construed as limited to the particular forms disclosed, since these are regarded as illustrative rather than restrictive. Moreover, variations and changes may be made by those skilled in the art without deporting from the spirit of the invention.

I claim:

1. A drop bolt system for door security comprising:

a. a doorjamb restraint mounted to a doorjamb and a cripple underlying the doorjamb such that the restraint protrudes from the doorjamb;

b. an elongate central metal plate having an upper edge and a mid-point along the length of the plate, rotatably mounted to a doorjamb frame, that releasably engages the doorjamb restraint at the mid-point of the plate; and c. a central plate latch that engages the upper edge of the central plate to releasably secure the central plate in engagement with the doorjamb restraint to prevent rotational movement of the central metal plate.

2. The system of claim 1 wherein the central plate latch is rotatably mounted to the doorjamb restraint.

3. The system of claim 1 further comprising a doorjamb facing formed integrally with the doorjamb restraint to mount the restraint to a doorjamb frame.

4. The system of claim 2 wherein the central plate latch includes an elongated slot there through and further comprising a rivet head on the doorjamb restraint that extends through the central plate latch that permits rotational and translational movement of the central plate latch relative to the doorjamb restraint.

5. A drop bolt system for door security comprising:

a. a doorjamb restraint mounted to a doorjamb and a cripple underlying the doorjamb such that the restraint protrudes from the doorjamb;

b. an elongate central metal plate having a mid-point on the length of the plate, an upper edge, and a hole therethrough, rotatably mounted to a doorjamb frame, that releasably engages the doorjamb restraint; and c. a pin insertable through the central plate hole to prevent rotation of the central plate.

6. The system of claim 5 further comprising a doorjamb facing formed integrally with the doorjamb restraint to mount the restraint to a doorjamb frame.

7. The system of claim 3 wherein the central plate is rotatably mounted to the doorjamb facing.

8. The system of claim 6 wherein the central plate is rotatably mounted to the doorjamb facing.

9. The system of claim 1 further comprising a plate latch stop on the doorjamb restraint to limit rotational movement of the central plate.

10. The system of claim 5 further comprising a plate latch stop on the doorjamb restraint to limit rotational movement of the central plate.

11. A method of securing a door against unauthorized entry comprising the steps of:

a. securing a doorjamb restraint to a doorjamb and a cripple underlying the doorjamb, the restraint protruding into dwelling space between the doorjamb and a door;

b. rotatably mounting a central plate to a door casing so that the central plate hangs free in an unlatched state and engages the doorjamb restraint in a latched state such that a portion of the central plate extends over the door casing and an equal portion of the central plate extends over the door; and c. movably mounting a plate latch to the doorjamb restraint to releasably secure the central plate in a latched state to prevent rotational movement of the central metal plate.

* * * * *